United States Patent [19]

Newman et al.

[11] 4,042,744

[45] Aug. 16, 1977

[54] MULTIPLE-COLOR TRANSFER ELEMENTS AND PROCESS

[75] Inventors: Douglas A. Newman; Allan T. Schlotzhauer, both of Glen Cove, N.Y.

[73] Assignee: Columbia Ribbon and Carbon Manufacturing Co., Inc., Glen Cove, N.Y.

[21] Appl. No.: 360,334

[22] Filed: May 14, 1973

Related U.S. Application Data

[63] Continuation-in-part of Ser. No. 213,534, Dec. 29, 1971, abandoned.

[51] Int. Cl.[2] ..... B41C 1/06

[52] U.S. Cl. ..... 428/307; 427/152; 427/352; 427/373

[58] Field of Search ..... 117/36.1, 36.3, 36.7; 428/307; 427/152, 352, 373

[56] References Cited

U.S. PATENT DOCUMENTS

| | | | |
|---|---|---|---|
| 1,364,788 | 1/1921 | Neidich | 117/36.3 |
| 2,728,439 | 12/1955 | Murphy et al. | 117/36.3 |
| 2,759,586 | 8/1956 | Juengerkes | 117/36.3 |
| 2,777,824 | 1/1957 | Leeds | 117/36.1 |
| 3,484,268 | 12/1969 | Newman | 117/36.1 |
| 3,511,788 | 5/1970 | Keil | 117/36.1 |
| 3,524,753 | 8/1970 | Sharp | 260/2.5 X |
| 3,682,683 | 8/1972 | Elbert et al. | 117/36.1 |

*Primary Examiner*—Bernard D. Pianalto
*Attorney, Agent, or Firm*—Thomas L. Tully

[57] ABSTRACT

Process for producing multicolor pressure-sensitive transfer elements comprising the steps of preparing a thin microporous resinous layer, impregnating a preselected partial area thereof with a liquid non-drying ink of one color and impregnating another adjacent preselected partial area thereof with another liquid non-drying ink of a different color, an ink barrier preferably being provided between said areas to prevent integration of said different colored inks.

11 Claims, 2 Drawing Figures

MULTIPLE-COLOR TRANSFER ELEMENTS AND PROCESS

This application is a continuation-in-part of parent application Ser. No. 213,534, filed Dec. 29, 1971 and now abandoned.

With the ever-increasing shift from fabric-base to film-base transfer elements such as typewriter ribbons, chain-printer ribbons, and the like, there is a growing demand for film-base transfer elements capable of providing liquid transfer inks of different colors, particularly black and red. Conventional film-base transfer elements of the so-called reusable type comprise a film foundation carrying a porous resinous layer containing pressure-exudable liquid ink. such transfer elements are most commonly produced by coating the film foundation with a volatile solvent solution of a resinous composition containing resin-incompatible liquid ink, and evaporating the solvent to form the ink-releasing porous resinous layer.

It is known to produce bicolor transfer ribbons of the reusable type by independently producing reusable transfer elements containing red and black inks respectively, cutting said elements into strips and adhering the strips in side-by-side relation on an adhesive backing. Such a process is expensive and tedious, due to the number of operations involved, and produces transfer elements having reduced imaging quality because of the thickness of the additional adhesive backing.

It is the principal object of the present invention to provide a novel method for producing multicolor transfer elements of the reusable type having a microporous resinous layer produced independently of the ink and containing adjacent areas of different-colored liquid inks, which areas have clearly defined boundaries free of integration.

It is another object of this invention to provide a method for producing multicolor transfer elements in two separate steps whereby the colors and dimensions of the ink areas are independent of the microporous resinous layer.

It is yet an object of an embodiment of this invention to provide a method for producing multicolor transfer elements having a barrier between adjacent areas of liquid ink of different colors.

These and other objects and advantages of the present invention will be apparent to those skilled in the art in the light of the present disclosure including the drawings, in which.

The objects and advantages of the present invention are accomplished by the discovery that reusable squeeze-out type transfer elements can be produced by a multistep process in which the microporous layer is produced independent of the ink, preferably pretreated in order to provide ink-receptive microporous areas, separated from each other by a barrier, and inked with different-colored liquid inks which are free of resin and free of volatile solvents for the microporous layer.

Basically, the method of the present invention comprises the steps of coating a casting surface or a film foundation with a continuous flowable resinous composition capable of providing a microporous layer, optionally treating said composition, either before or after it becomes a microporous layer, to provide a barrier strip which is non-receptive to liquid ink and which separates said microporous layer into adjacent microporous stripes which are receptive to liquid ink, and applying liquid inks of different colors to said adjacent stripes.

Figure 1:
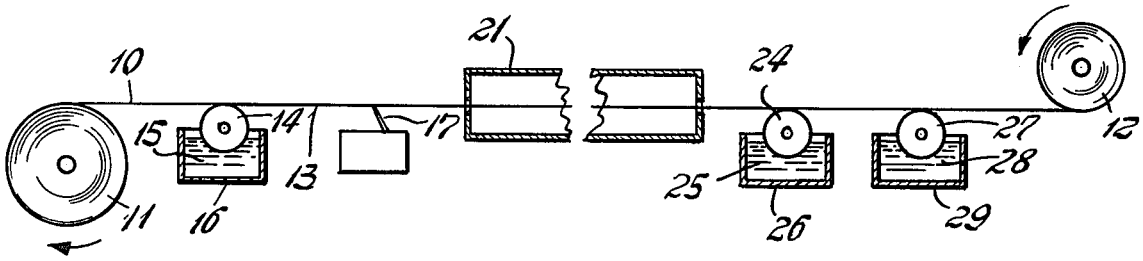
FIG. 1 is a plan view illustrating an apparatus suitable for carrying out the method according to one embodiment of the present invention.

Referring to the drawings, FIG. 1 illustrates a continuous web of plastic film 10, such as 0.5 mil Mylar polyethylene terephthalate, drawn from supply roll 11, treated, and collected on take-up roll 12. The treatment comprises five steps of stations, the first step involving the application of a continuous resinous layer 13 capable of being rendered microporous. Layer 13 is applied to the film 10 by means of printing roller 14 which receives a continuous supply of the required resinous composition 15 from vat 16. Thereafter the layer 13 is contacted by a scraper 17 which removes and/or displaces the layer along a straight strip 18 to form separate stripes 19 and 20 which are capable of being rendered microporous, shown in FIG. 2.

The apparatus of FIG. 1 is suitable for use with resinous compositions capable of being rendered microporous by application of heat, such as compositions containing a heatactivatable blowing agent. Thereafter the web passes next through a hot air tunnel 21 which renders the stripes 19 and 20 microporous, transforming them into ink-absorbent stripes 22 and 23, shown in FIG. 2.

Next the film web is contacted with staggered inking stations, the first comprising an inking roller 24 having a width and position corresponding to stripe 22 for the application of liquid, non-drying ink 25, such as black ink, from vat 26. Thereafter the film web is contacted with the second inking roller 27 having a width and position corresponding to stripe 23 for the selective application of liquid, non-drying ink 28, such as red ink, from vat 29.

The final web, having adjacent inked stripes 30 and 31 separated by non-receptive barrier strip 18, is collected on take-up roll 12 for further processing.

It should be understood that various compositions and methods may be used to produce the present microporous layers and that various methods may be used to produce the barrier strips separating adjacent ink-receptive microporous stripes. Thus the compositions and methods taught by parent application, Ser. No. 213,534, filed Dec. 29, 1971, illustrate the incorporation of heat-activatable blowing agents in the resinous composition applied to the film web.

Another suitable method involves the incorporation of a leachable solid such as a salt in the resinous composition, followed by removal of the solid by washing after the resinous composition has been coated and solidified. Suitable solids include sodium chloride.

The preferred resinous binder materials include the vinyl resins such as vinyl chloride-vinyl acetate copolymer, the acrylics such as ethyl acrylate polymers, alcohol-soluble nylon, cellulose acetate butyrate, and the like.

The step of producing the barrier strip and adjacent microporous stripes may be varied greatly depending upon whether it is carried out before, during or after the step of rendering the resinous layer microporous. The barrier strip may be produced by the removal or displacement of the resinous composition either before or after it is rendered porous. The barrier strip may also be produced by selectively preventing the resinous composition from being rendered porous in the area corresponding to the barrier strip, such as by excluding the blowing agent therefrom or by preventing heat-activation of the blowing agent or removal of the leachable solid in said area, or by applying a thin stripe of resin or other material to fill the pores in said area. Finally the barrier strip may be produced, after the entire layer has been rendered microporous, by applying a heated stylus or wafer roller against the layer to collapse the layer and destroy its porosity in areas corresponding to the barrier strip.

The liquid non-drying inks used according to the present invention may be conventional typewriter ribbon inks comprising pigment and/or dyestuff and non-drying oil vehicle such as mineral oil, rapeseed oil, oleic acid, butyl stearate, and the like. If no barrier is provided to separate the different-colored ink applications in the microporous layer, then the different-colored inks should be based upon different oil ink vehicles which are incompatible and immiscible with each other to prevent migration of one ink into the other.

The following example is given as an illustration of one method for carrying out the present invention and should not be considered limitative.

EXAMPLE

A continuous web of 0.5 mil Mylar may be coated on one surface with a thin layer of the following resinous composition:

| Ingredients | Parts by Weight |
|---|---|
| Vinyl chloride-vinyl acetate copolymer | 20 |
| Sodium chloride (granulated) | 60 |
| N,N'-dimethyl, N,N' dinitroso terephthalamide | 1 |
| Methyl ethyl ketone | 80 |
| Heptane | 30 |

The composition is heated to 80° C to evaporate the ketone solvent and leave the heptane non-solvent dispersed in droplet form throughout the coating which also contains the sodium chloride particles and terephthalamide uniformly dispersed throughout.

Next the temperature is raised to 100° C to evaporate the heptane and provide a porous resin layer. The temperature is increased to 120° C to cause the terephthalamide blowing agent to decompose and release a nitrogen gas, producing further porosity within the layer.

Finally the porous layer may be washed with water to dissolve out the sodium chloride particles and provide a vinyl resin layer having a high degree of interconnected porosity. The porosity caused by the evaporation of the heptane and decomposition of the blowing agent facilitates the dissolving out of the salt particles. Finally the porous web is heated to remove the water and form a dry porous coating of the Mylar film foundation.

Figure 2:
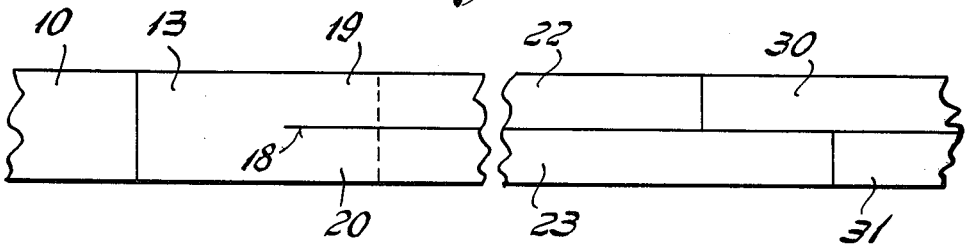
FIG. 2 is a bottom view of the web of FIG. 1 illustrating the condition of the web at the various stages of treatment.

To produce typewriter ribbons, the porous web may be cut into ribbon widths while simultaneously rolling a dull heated disc roller down the middle of the porous layer to fuse the porous vinyl resin layer and destroy its porosity without cutting or weakening the Mylar product, thus producing a nonporous barrier strip such as that illustrated at 18 in FIG. 2 of the drawings. If desired, the barrier strip may be produced in advance by removal of the vinyl coating from the substrate as discussed supra in connection with FIG. 1 of the drawings.

Finally the porous coating, divided into separate adjacent stripes such as 22 and 23 shown in FIG. 2, may be inked by applying different non-drying liquid inks to each stripe to fill the pores of the vinyl resin coating of each stripe with a different-colored ink and produce a multicolor ribbon. If desired, the inks may contain the same oily vehicle and differ only with respect to the colored pigment and/or dye in cases where a barrier is provided to separate the inks from each other. The differnt inks remain sharply separated from each other because of the intermediate, non-absorbent barrier strip and because of capillary attraction which holds each of the liquid inks within the porous vinyl layer to which it is applied.

The single example given above incorporates three means for producing porous resin coatings useful according to the present invention, namely the use of a volatile liquid which is less volatile than the volatile solvent for the resin and which itself is a non-solvent for the resin, the use of a conventional solid blowing agent which decomposes and liberates a gas when heated, and a solid which is leachable by means of a solvent which is a non-solvent for the resin.

While the presence of the thin barrier strip represents a preferred embodiment of the invention, it should be understood that suitable transfer elements can be produced without any barrier strip because the microporous structure of the resinous layer holds the respective inks in place by capillary action, as opposed to ribbon fabrics which permit the inks to migrate. Further protection against integration of the different-colored inks at the interface is provided by basing each ink upon a liquid vehicle which is incompatible or immiscible with the liquid vehicle of the other ink, i.e., mineral oil in one ink and castor oil in the other ink.

Also, while the present transfer elements are preferably produced by forming the microporous resin layer on a flexible film such as Mylar, polypropylene, cellulose acetate or other foundation, such as paper, which is retained as a support for the transfer element, it is also possible to produce the microporous resin layer on a casting surface and to remove the layer for subsequent inking and use as a self-supporting transfer element. A resinous coating may be applied to one surface to provide a sealing layer, if desired.

Variations and modifications may be made within the scope of the claims and portions of the improvements may be used without others.

I claim:

1. Process for producing a pressure-sensitive multicolor liquid ink-releasing transfer element comprising the steps of:

a. preparing a composition comprising a heat-activatable solid blowing agent, a dispersed granulated solid which is soluble in a volatile liquid, a synthetic thermoplastic film-forming resin and a volatile liquid solvent for said resin which is a non-solvent for said dispersed granulated solid;

b. coating said composition as a thin layer and evaporating said solvent to form a solidified layer of said resin containing said blowing agent and dispersed granulated solid;

c. heating said solidified layer to activate and remove said blowing agent from said layer to form a dry microporous layer of said resin containing said dispersed granulated solid;

d. treating and dry microporous layer with a volatile liquid which is a solvent for said dispersed granulated solid but is a non-solvent for said resin, to dissolve and remove said dispersed granulated solid and form a microporous layer of said resin containing empty, interconnected pores capable of absorbing a liquid ink;

e. impregnating one area of said microporous layer with a liquid ink having one color and comprising a non-drying oil and coloring matter; and f. impregnating another area of said microporous layer adjacent said one area with a liquid ink having a different color and comprising a non-drying oil and coloring matter, to provide a transfer element capable of exuding said different colored inks under the effects of imaging pressure applied to said different areas.

2. Process according to claim 1 in which said thin layer of resinous composition is formed on a plastic film foundation which is retained as the support of said transfer element.

3. Process according to claim 1 in which the resinous composition also contains a volatile liquid which is a non-solvent for the film-forming resin and is less volatile than the volatile liquid solvent, and said volatile liquid is removed from the solidified layer of step (b), after evaporation of said solvent, to form a porous solidified layer of said resin containing said blowing agent and said dispersed granulated solid, followed by steps (c) through (f).

4. Process according to claim 1 in which said microporous resinous layer is treated, prior to being inked, in order to provide a thin, continuous barrier strip which is not capable of absorbing liquid ink, the different-colored inks being applied to areas of the microporous layer at opposite sides of said barrier strip.

5. Process according to claim 4 in which said barrier strip is produced by destroying the porosity of the microporous layer in the area of the barrier strip.

6. Process according to claim 4 in which said barrier strip is produced by removal of the resinous layer, before or after it is rendered microporous.

7. Multicolor pressure-sensitive transfer element prepared according to the process of claim 1.

8. Transfer element according to claim 7 in which a thin, continuous barrier strip which is not capable of absorbing the liquid ink is present between said one area and said other area.

9. Transfer element according to claim 8 in which the barrier strip comprises a non-porous, heat-fused area of said microporous layer.

10. Transfer element according to claim 7 in which said liquid inks each comprise a liquid oily vehicle which is incompatible with said synthetic resin.

11. Transfer element according to claim 7 in which a flexible plastic film foundation is present as a support for said microporous layer.

* * * * *

UNITED STATES PATENT AND TRADEMARK OFFICE

CERTIFICATE OF CORRECTION

PATENT NO. : 4,042,744

DATED : August 16, 1977

INVENTOR(S) : Douglas A. Newman & Allan T. Schlotzhauer

It is certified that error appears in the above-identified patent and that said Letters Patent are hereby corrected as shown below:

Column 1, line 15, the letter "s" in the word "such" should be capitalized---Such---; Column 2, line 11, the word "of" should be---or---; Column 3, line 59/60, the word "product" should be---support---; Column 4, line 64, the word "and" should be---said---.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*